US007336146B2

(12) United States Patent
Elrick et al.

(10) Patent No.: US 7,336,146 B2
(45) Date of Patent: Feb. 26, 2008

(54) MOVING CONTACT CARRIER ARRANGEMENT FOR A CIRCUIT BREAKER MECHANISM

(75) Inventors: David Alexander Elrick, Kempton Park (ZA); Ian David Wiggins, Eden Glen (ZA); Dante Bagalini, Waverley (ZA)

(73) Assignee: Circuit Breaker Industries Ltd. (ZA)

( * ) Notice: Subject to any disclaimer, the term of this patent is extended or adjusted under 35 U.S.C. 154(b) by 0 days.

(21) Appl. No.: 11/373,502

(22) Filed: Mar. 13, 2006

(65) Prior Publication Data

US 2007/0212928 A1 Sep. 13, 2007

(51) Int. Cl.
*H01H 75/00* (2006.01)

(52) U.S. Cl. ..... 335/16

(58) Field of Classification Search ..... 335/16, 335/147, 195; 200/244, 276
See application file for complete search history.

(56) References Cited

U.S. PATENT DOCUMENTS 3,080,462 A * 3/1963 Casey ..... 335/16
3,365,561 A * 1/1968 Kiesel et al. ..... 200/278
4,931,603 A * 6/1990 Castonguay et al. ..... 218/1
5,146,194 A * 9/1992 Altenhof et al. ..... 335/16
5,517,164 A * 5/1996 Zoller et al. ..... 335/16

* cited by examiner

*Primary Examiner*—Neil Abrams
(74) *Attorney, Agent, or Firm*—Seyfarth Shaw LLP

(57) ABSTRACT

A circuit breaker mechanism comprises a line terminal, a load terminal and a set of contacts between the terminals. A fixed contact is connected to the line terminal, and a moving contact is connected to the load terminal via a conductive frame and a load sensing element. The moving contact is fixed to a contact carrier which is supported pivotably on conductive pins which are electrically connected to the frame. A spring urges the contact carrier into snug engagement with the conductive pins. The arrangement obviates the need for a flexible conductive pig-tail to form a current path between the contact carrier and the frame, simplifying the construction and improving the performance of the circuit breaker. With this arrangement, the current path extends from the line terminal to the moving contact, through the contact carrier, through the conductive pins, to the conductive frame and through the load sensing element to the load terminal.

7 Claims, 2 Drawing Sheets

MOVING CONTACT CARRIER ARRANGEMENT FOR A CIRCUIT BREAKER MECHANISM

BACKGROUND OF THE INVENTION

This invention relates to a circuit breaker mechanism. In particular, the invention relates to the arrangement of a contact carrier forming part of the mechanism.

The conduction path of a circuit breaker typically includes a line terminal and a load terminal, with a set of contacts and a load sensing device between the contacts. Conventionally, the set of contacts comprises a fixed contact and a moving contact, with the moving contact being mounted on a contact carrier which is supported pivotably on a frame member of the mechanism. In known miniature circuit breakers, the contact carrier is mounted pivotably to an operating handle which in turn is supported pivotably on a handle frame of the circuit breaker mechanism. The handle frame also serves as part of the conduction path of the mechanism. A flexible conductor, known as a pig-tail, is welded to the moving contact carrier and to the handle frame and flexes with the movement of the contact carrier between a first position in which the contacts are closed and a second position in which the contacts are open.

The flexible pig-tail is typically welded to the contact carrier and the handle frame. The welding process can cause distortion of the contact carrier, resulting in the contact carrier rubbing on the shell or housing of the circuit breaker, negatively affecting the switching action of the mechanism. It will also be appreciated that the stiffness, the orientation and the length of the flexible pig-tail have a direct effect on the contact pressure and other operating characteristics of the circuit breaker mechanism.

It is an object of invention to provide a circuit breaker mechanism which reduces or does away with the need for a flexible conductor or pig-tail of the kind described above.

SUMMARY OF THE INVENTION

According to the invention there is provided a circuit breaker mechanism comprising a first terminal, a second terminal, a fixed contact connected to the first terminal, a conductive frame arranged to support an operating handle of the circuit breaker and connected electrically to the second terminal, and a moving contact assembly including a moving contact arranged to make contact with the fixed contact and a contact carrier supported pivotably on the conductive frame and connected both electrically and mechanically to said conductive frame only via a conductive pivot pin.

Typically, the first terminal is a line terminal and the second terminal is a load terminal.

The contact carrier preferably comprises a conductive member, the moving contact being supported at or near a first end of the conductive member and an opposed second end of the conductive member being shaped to engage at least one conductive pivot pin connected electrically to the conductive frame.

In a preferred embodiment of the invention, the conductive member comprises a pair of generally parallel elongate limbs connected together, the moving contact being supported at or near a first end of the conductive member and the ends of the limbs at an opposed second end of the conductive member having recesses formed therein to engage respective conductive pivot pins connected electrically to the conductive frame.

The mechanism may include a conductive bracket fixed to the conductive frame, the conductive bracket defining a pair of conductive pivot pins arranged to engage the respective ends of the limbs of the contact carrier.

The conductive bracket preferably comprises copper.

The conductive bracket may support a conductive handle pivot pin to which an operating handle of the mechanism is mounted, and which connects the conductive bracket electrically to the conductive frame.

The conductive handle pivot pin is preferably formed from copper.

The mechanism preferably includes at least one spring, which may be the main spring of the mechanism, arranged to urge the contact carrier of the moving contact assembly against said at least one conductive pivot pin.

DESCRIPTION OF AN EMBODIMENT

Figure 1:
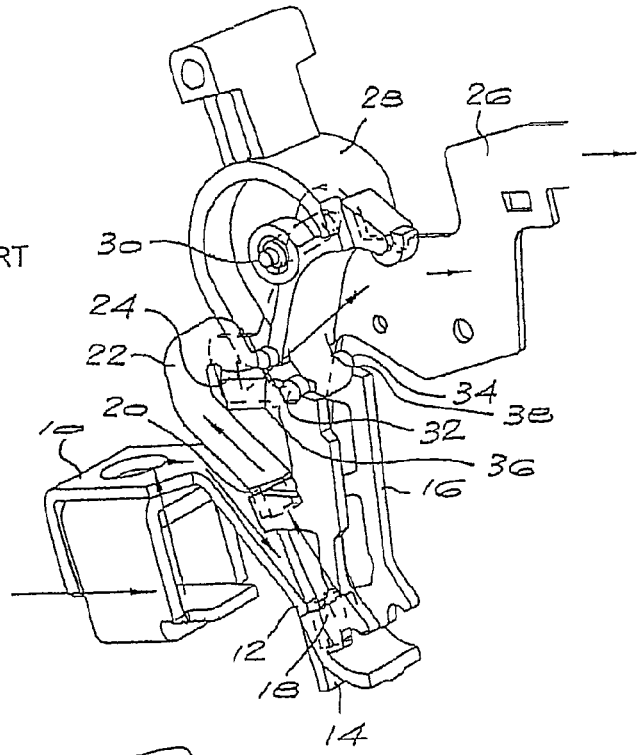
Fig.1 PRIOR ART
FIG. 1 is a pictorial view of a portion of a prior art miniature circuit breaker mechanism, showing the configuration of a moving contact carrier thereof.

FIG. 1 shows a portion of an existing miniature circuit breaker mechanism manufactured by the applicant. A line terminal 10 defines a fixed contact 12 with an integral arc runner 14. Mounted adjacent to the fixed contact 12 is a contact carrier 16 which carries a moving contact 18. Welded to the contact carrier 16 adjacent to the moving contact 18 is a first end 20 of a flexible conductor or pig-tail 22. The other end 24 of the pig-tail is welded to one end of a handle frame 26 that is preferably formed from copper. The handle frame supports an operating handle 28 of the circuit breaker mechanism on a pin 30. The lower end of the handle 28 defines a pair of opposed pins 32 and 34 having a part-circular profile, against which correspondingly shaped semi-circular recesses 36 and 38 in the upper end of the contact carrier 16 bear pivotably.

The electrical conduction path of the circuit breaker mechanism of FIG. 1 is illustrated by the arrows from left to right in the Figure. It should be appreciated that the current path from the moving contact 18 to the handle frame 26 is entirely via the pig-tail 22. The handle 28 is typically formed from an insulating plastics material and there is thus no conduction path between the contact carrier 16 and the handle frame 26 via the handle 28.

Figure 2:
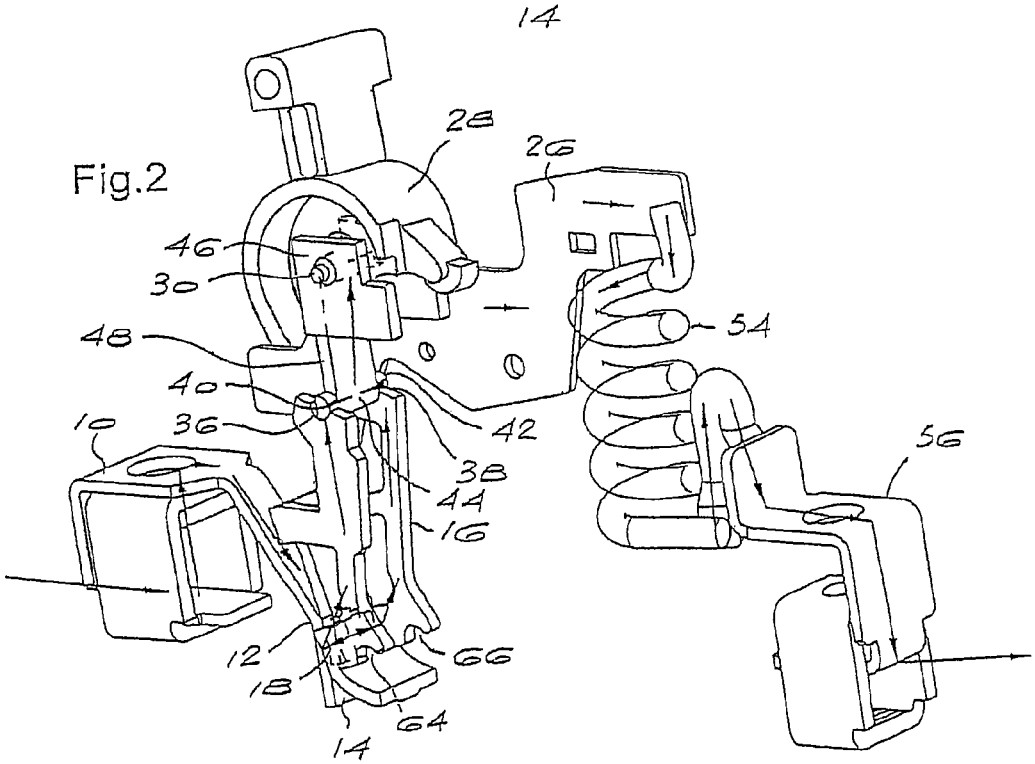
FIG. 2 is a pictorial view of a part of a circuit breaker mechanism according to the invention, showing the conduction path thereof between a line terminal and a load terminal.

The circuit breaker mechanism of the invention is illustrated in FIG. 2. Many of the components of the mechanism shown in FIG. 2 are similar or identical to those in FIG. 1 and therefore have the same reference numerals.

The arrangement of the line terminal 10 and the fixed contact 12 are the same as in the mechanism of FIG. 1. The contact carrier 16 is also unchanged, and essentially comprises a pair of generally parallel elongate limbs connected together. However, instead of engaging pins 32 and 34 defined by the handle 28, the recesses 36 and 38 at the upper end of the contact carrier bear against respective opposed pins 40 and 42 formed at the lower end 44 of a conductive bracket 46. The bracket 46 is fixed to the handle frame 26 and is in good electrical contact with it. The bracket 46 is generally U-shaped with a depending leg 48, the bearing/contact pins 40 and 42 being formed at the lower end 44 of the leg 48.

The bracket 46 is preferably formed from copper of adequate hardness, plated with tin or silver, for example, to enhance its conductivity and provide suitable mechanical properties. The pins 40 and 42 can be formed integrally with the copper bracket, as shown, or could be brazed or otherwise fixed to the lower end of the bracket. In the latter case the pins could be formed of brass or bronze. The pins are preferably also plated with tin or silver.

The pins 40 and 42 define smoothly curved bearing surfaces on which the recesses 36 and 38 at the upper end of the contact carrier 16 pivot.

Figure 3:
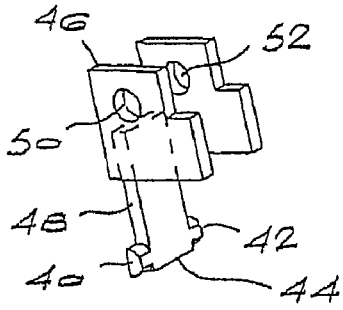
FIG. 3 is a pictorial view of a conductive support member forming part of the mechanism of FIG. 2.

As best seen in FIG. 3, the bracket 46 has a pair of apertures 50 and 52 in opposed limbs of the U which are aligned with a corresponding aperture (not shown) in the handle frame 26 when the conductive bracket 46 is fixed to the handle frame. A copper handle pin 30 is fitted through the apertures 50 and 52, helping to ensure good electrical contact between the bracket 46 and the handle frame.

Welded to the end of the handle frame 26 remote from the bracket 46 is one end of a load sensing coil 54, the other end of which is welded to a load terminal 56. The current conduction path of the mechanism of FIG. 2 is illustrated by the arrows moving from left to right in the Figure and it can be seen that instead of there being a current path between the contact carrier 16 and the handle frame 26 via a flexible conductive pig-tail, the conduction path between the moving contact carrier 16 and the handle frame 26 is via the pins 40 and 42 of the conductive bracket 46.

Figure 4:
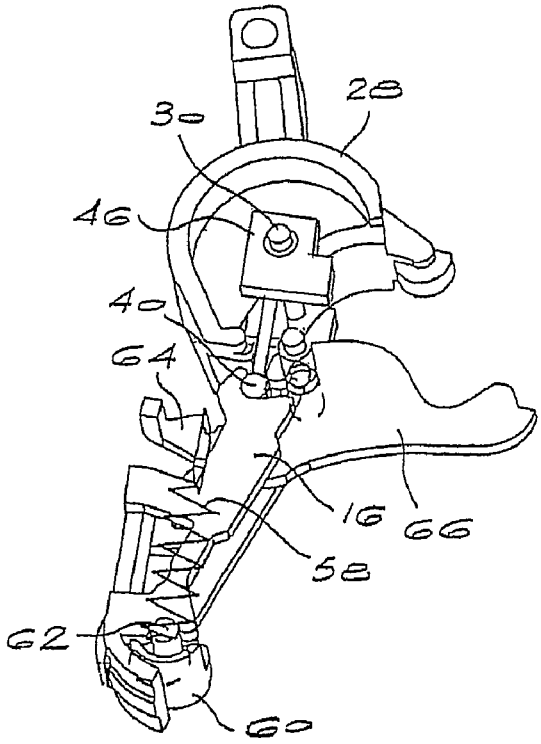
FIG. 4 is a pictorial view of the moving contact carrier of the mechanism of FIG. 2 engaged with a handle and a trip lever of the mechanism.

In order to ensure good contact between the upper end of the moving contact carrier 16 and the pins 40 and 42 of the bracket 46, the main spring 58 of the mechanism (shown schematically in FIG. 4) is arranged to urge the contact carrier into firm engagement with the pins. An arc shield 60 is fitted to the lower end of the contact carrier 16 and has opposed transversely extending pins 62 which are received in respective notches 64 and 66 in the contact carrier. The main spring 58 extends between one pin 62 and one end 64 of a trip lever 66 forming part of the mechanism. The main spring 58 applies a sufficiently great component of force along the length of the contact carrier 16 to urge its upper end into firm contact with the pins 40 and 42, ensuring good electrical contact between the contact carrier and the pins.

In a prototype version of the described mechanism, rated at 63A, a moderate temperature increase of the order of 10 degrees C. was noted in use at the rated load, compared with a conventional mechanism. However, the temperature at the load and line terminals remained substantially unchanged. If the temperature rise should be considered objectionable, the use of a copper top frame would assist in heat dissipation. It is also possible to use a pig-tail in addition to the described pivoting contact arrangement. In such a case a pig-tail can be smaller and lighter than in the case of the described prior art circuit breakers, for a given rating.

The main advantage of the described circuit breaker mechanism is that a consistent contact pressure can be maintained due to the absence of the pig-tail and any variations in the geometry of the contact carrier and other unwanted effects caused by the pig-tail. A softer main spring can be used as the variation in contact pressure and operating characteristics of the mechanism due to variations in the pig-tail characteristics is eliminated.

The described mechanism has an improved switching action due to the fact that the movement of the moving contacts is not impeded by the pig-tail, resulting in higher contact closing/opening speeds, and also by the fact that deformation of the moving contact carrier due to welding is eliminated and thus the moving contact carrier does not tend to rub on the frame or shell of the circuit breaker. Similarly, "stickiness" of the operating handle is avoided. Another advantage is that the elimination of the pig-tail allows the line terminal to be reshaped to form a closer loop with the contact carrier, improving blow-off during short circuit conditions, with a potential improvement in short circuit performance. The arrangement also provides for additional space for levers operating an "in-line trip alarm/auxiliary switch" mechanism. Finally, construction is simplified due to the absence of the welded pig-tail, with a possible cost saving.

We claim:

1. A circuit breaker mechanism comprising a first terminal, a second terminal, a fixed contact connected to the first terminal, a conductive frame arranged to support an operating handle of the circuit breaker and connected electrically to the second terminal, and a moving contact assembly including a moving contact arranged to make contact with the fixed contact and a contact carrier supporting the moving contact and supported pivotably on the conductive frame, the contact carrier comprising a conductive member, the moving contact being supported at or near a first end of the conductive member and an opposed second end of the conductive member having at least one recess formed therein which is shaped to engage at least one conductive contact carrier pivot pin connected electrically to the conductive frame, so that the contact carrier is connected both electrically and mechanically to said conductive frame only via said at least one conductive contact carrier pivot pin.

2. A circuit breaker mechanism according to claim 1 wherein the first terminal is a line terminal and the second terminal is a load terminal.

3. A circuit breaker mechanism according to claim 1 wherein the conductive member comprises a pair of generally parallel elongate limbs connected together, the moving contact being supported at or near a first end of the conductive member and the ends of the limbs at an opposed second end of the conductive member having respective recesses formed therein to engage respective conductive contact carrier pivot pins connected electrically to the conductive frame.

4. A circuit breaker mechanism according to claim 1 including a conductive bracket fixed to the conductive frame, the conductive bracket defining a pair of conductive pivot pins arranged to engage the respective ends of the limbs of the contact carrier.

5. A circuit breaker mechanism according to claim 4 wherein the conductive bracket comprises copper.

6. A circuit breaker mechanism according to claim 5 wherein the conductive handle pivot pin is formed from copper.

7. A circuit breaker mechanism according to claim 1 including at least one spring arranged to urge the contact carrier of the moving contact assembly against said at least one conductive contact carrier pivot pin.

* * * * *